United States Patent [19]

Obenshain

[11] 3,935,769

[45] Feb. 3, 1976

[54] TANDEM COLLECT SINGLE WEB SHEET CUTTER AND STACKER

[75] Inventor: David Noel Obenshain, Swanton, Md.

[73] Assignee: Westvaco Corporation, New York, N.Y.

[22] Filed: June 28, 1974

[21] Appl. No.: 484,248

[52] U.S. Cl. ..... 83/79; 83/91; 83/94; 83/98; 270/60

[51] Int. Cl.² ..... B65H 35/08

[58] Field of Search ..... 83/79, 90, 91, 98, 99, 83/86, 94; 93/93 R; 271/196; 270/60

[56] References Cited

UNITED STATES PATENTS

| | | | |
|---|---|---|---|
| 1,593,235 | 7/1926 | Barber | 270/60 |
| 2,278,188 | 3/1942 | Bamford et al. | 270/60 |

*Primary Examiner*—Frank T. Yost

[57] ABSTRACT

An apparatus for cutting, sorting and stacking paper or the like in sheet form is disclosed which includes means for collecting packets of sheets in tandem on a collecting drum prior to discharging the collected sheets to the stacker. The basic components consist of a sheet cutting section, a sheet collecting section, a sheet slow down section and a stacker unit. In the tandem collect mode of operation, the length of the cut sheets must be less than one-half the circumference of the collecting drum and the drive ratio between the sheet cutting section and the sheet collecting section is set at 2:1. Packets of sheets containing an odd number of sheets are collected in tandem on the collecting drum with the use of air showers that are controlled by microswitches in an air shower control unit that is driven by the cutting drum. The drive ratio between the cutting drum and the air shower control unit and the number of microswitches in the air shower control unit determine the number of sheets collected in each packet.

8 Claims, 18 Drawing Figures

Fig 11.
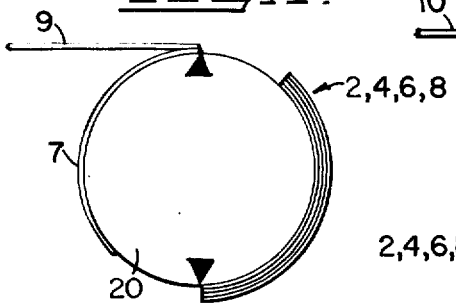
Fig 12
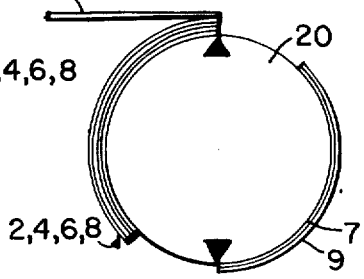
Fig 13.
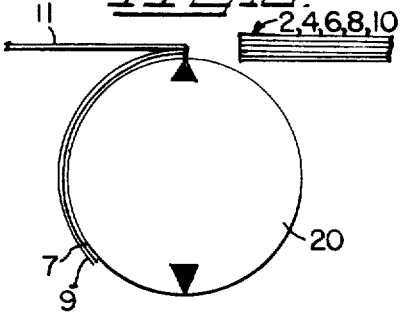
Fig 14.
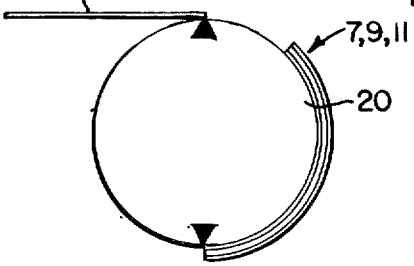
Fig 15.
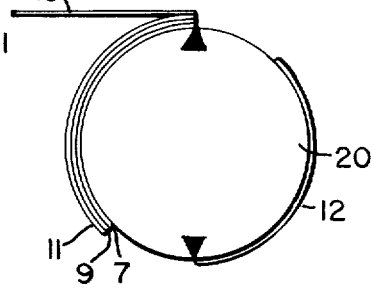
Fig 16.
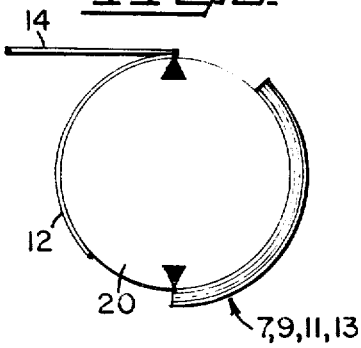
Fig 17.
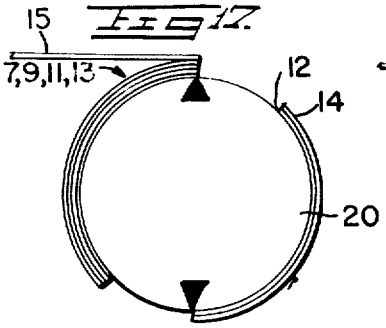
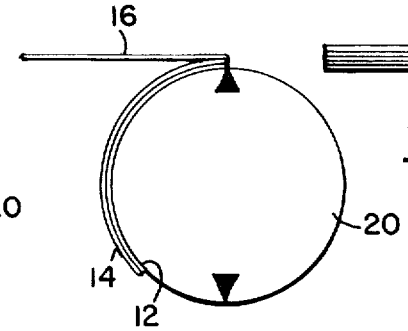
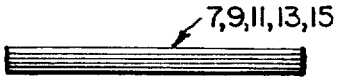
Fig 18.

TANDEM COLLECT SINGLE WEB SHEET CUTTER AND STACKER

BACKGROUND OF INVENTION

The present invention relates generally to the art of cutting, sorting and stacking paper or the like in sheet form in a continuous operation, and with such accuracy, precision and freedom from dust, that the paper so stacked requires no further handling other than wrapping, weighing and labeling prior to delivery to the customer. The operation is performed at high speed preferably on a single web of paper, and the final stacked sheets are sold under the trademark "Accu-Trim" paper, marketed by the assignee herein. Moreover, the invention herein is an improvement in applicant's prior U.S. Pat. Nos. 3,203,326 and 3,272,044, and incorporates features disclosed in applicant's prior U.S. Pat. No. 3,363,520. Accordingly, for the purpose of providing a complete disclosure of the present invention the disclosures of the aforementioned U.S. patents should be considered as incorporated herein by reference.

The present invention consists essentially of the following basic components, including an unwind stand (not shown herein), a web inspection device, a cutting section, a tape type sheet receiving and sorting section, a sheet collecting section, a sheet slow down section and a sheet stacker all substantially as disclosed in applicants prior patents. Furthermore, for the present invention, the various machine components used in the aforementioned patents would be useful, except that the sheet-collecting drum used herein is of the type more fully disclosed in applicant's U.S. Pat. No. 3,363,520.

The contribution of the present invention to the various machine components disclosed in applicant's prior patents comprises an improved air shower control for the sheet collecting drum which enables the machine to cut sheets at a higher rate with a reduced load on the slow down section of the machine.

SUMMARY OF INVENTION

The present invention relates to a novel means for collecting and transferring sheet material in packets and, more particularly, for collecting and transferring sheet material prepared by a single web sheet cutter and stacker device used in the manufacture of Accu-Trim paper.

The novelty of the present invention lies in the fact that by incorporating the improvements disclosed herein, the machines disclosed in applicant's prior U.S. Pat. Nos. 3,203,326 and 3,272,044 can be made to cut and stack more paper than their design potential and at a reduced load on their slow down systems. The above virtues of the present invention are achieved with the machines disclosed in applicant's prior patents in those cases where the sheets being cut are not greater in length than about half the maximum length of the sheet that can be cut and collected in the single sheet collection mode. Thus in the present case, as was the case with the machines disclosed in applicant's prior patents, the collecting drum, tape drive rolls and drive ratios are typical for a machine to handle sheets 39–78 inches in length in the single collect mode at up to 300 CPM (cuts per minute). Under these conditions (300 CPM), a 78 inch sheet length would require a tape speed of about 2000 feet per minute and the slow down system of the machine would be taxed to its limits with the deceleration-acceleration rates being at a maximum. However, in the tandem collect mode, as provided for by the present invention, the same machine can be operated up to 400 CPM on sheets ranging in size from about 22–39 inches in length. Accordingly, when cutting and collecting sheets of a length less than about one-half of the circumference of the collecting drum in the tandem collect mode, the sheet cutting portion of the machine can be operated at or near its maximum speed while the remainder of the machine is running at half the speed of the cutter drum.

In carrying out the above noted results, the present invention incorporates an air shower control unit into the machine which operates in the tandem collect mode at the same speed as the cutter drum. The air shower control unit consists of a rotating cam and a plurality of microswitches which trigger the solenoid valves that operate the transfer air shower and the sheet collect air shower when contacted by the rotating cam. The cam is driven by the cutting drum drive at a speed ratio that corresponds to the number of sheets collected in each packet. The machine shown schematically in the drawing herein is set-up for a five sheet packet, thus the speed ratio between the cam and the cutter drum is 5:1. However, the machine could be set-up to collect any odd number of sheets in each packet. The number of sheets in each packet must be an odd number for tandem collect to insure that the sheet packs build up alternately on the collecting drum. On the other hand, one could easily change the sheet collecting system to a seven sheet pack for instance by adding two more microswitches to the air control unit and changing the drive ratio between the cutter drum and cam to 7:1. However, as pointed out hereinbefore, the primary virtue of the tandem collect system lies in the speed relationship between the sheet cutting section and the sheet collecting section of the machine. Accordingly, with the machine in the tandem collect mode, the drive ratio between the sheet cutting section and the sheet collecting section is 2:1. Thus the sheet collecting drum operates at one-half the speed of the cutter drum which provides the reduced load on the sheet slow down system at normal operating speeds of the cutter drum. This reduced load on the slow-down-speed-up drive motor in the tandem collect mode can be readily seen from a review of the data in the following table.

TABLE

| Cuts Per Min. | Initial Tape Speed (FPM) | Time Per Cut (Sec) | Decel. Accel. Time (Sec) | Decel. Accel. Rate (Ft./sec./sec.) |
|---|---|---|---|---|
| SINGLE COLLECT MODE | | | | |
| 200 | 1337 | .300 | .893 | 22.13 |
| 250 | 1672 | .240 | .715 | 35.43 |
| 300 | 2006 | .200 | .596 | 51.85 |
| 350 | 2340 | .171 | .509 | 71.63 |
| TANDEM COLLECT MODE | | | | |
| 200 | 668 | .300 | .789 | 10.94 |
| 300 | 1003 | .240 | .510 | 27.88 |
| 350 | 1170 | .171 | .432 | 39.35 |
| 400 | 1337 | .150 | .377 | 52.41 |

The above data was calculated for a typical machine having a collecting drum of about 80 inches in circumference with a cutter drum of approximately the same size. Thus the typical machine is capable of a maximum sheet length collection in the single collect mode of about 78 inches and in the tandem collect mode of about 39 inches, and the data above was calculated for the maximum sheet length for each mode of collection. The delivery speed at which sheets can be delivered to the stacker is about 150 FPM (feet per minute). Thus it can be seen immediately that the initial tape speed (synchronized speed) is considerably higher than the delivery speed and is directly proportional to the number of cuts per minute. Of course, the time per cut is also directly related to the cuts per minute. The deceleration/acceleration rate depends on the number of cuts per minute and the distance between the entrance to the slow down tapes and the exit from the tapes. However, for a slow down tape system of a fixed length, the slow down photocell for large sheets in the single collect mode must be closer to the entrance of the slow down system than the slow down photocell for smaller sheets in the tandem collect mode. Thus the time permitted for the slow down tapes to decelerate and then accelerate back to sync speed for each delivery decreases as the frequency of cuts per minute increases. In like manner, the deceleration/acceleration rate increases as for the frequency of cuts per minute increases and the deceleration/acceleration rate is directly proportional to the load on the slow down drive motor. When this rate is multiplied by the inertia of the tape slow down system, the number obtained can be converted directly into horsepower. Accordingly, it may be seen from the data above that the deceleration-/acceleration rate at 300 CPM in the single collect mode is just about equal to the rate at 400 CPM in the tandem collect mode. Thus, the horsepower required for the sheet slow down motor and thus the load on the sheet slow down system is reduced at equivalent cutting rates in tandem collect as compared to single collect.

At the lower tape speeds used in the tandem collect mode the slow down distance is reduced and under these conditions, the length of the slow down system can also be reduced. However, with a machine capable of single or tandem collect, the slow down system would be designed to handle the longest sheets possible in the single collect mode. Moreover, since the tape system is not shortened for tandem collect the location of the photocell which initiates slow down is different for single collect and tandem collect. The drawing herein shows the two different photocell locations for the two different conditions.

It is also conceivable that the tandem collect system disclosed herein would make the machines more readily adapted for cutting heavy papers or paperboards (.012 inch thick and greater). For this purpose, larger collecting drums would be employed so that the sheets would not have to bend as much. The optimum slow down speed would be based on the average tape speed with the collecting drum operating at one-half the cutter drum speed. For even shorter sheets, i.e., sheets having a length substantially less than one-half the maximum sheet length permissable, either triple or quadruple tandem collect could be employed.

DESCRIPTION OF DRAWING

FIGS. 4–18 show the collecting drum of the present invention in diagrammatic form as sheets of paper are collected and transferred from machine start-up through 7½ revolutions.

DETAILED DESCRIPTION

Figure 2:
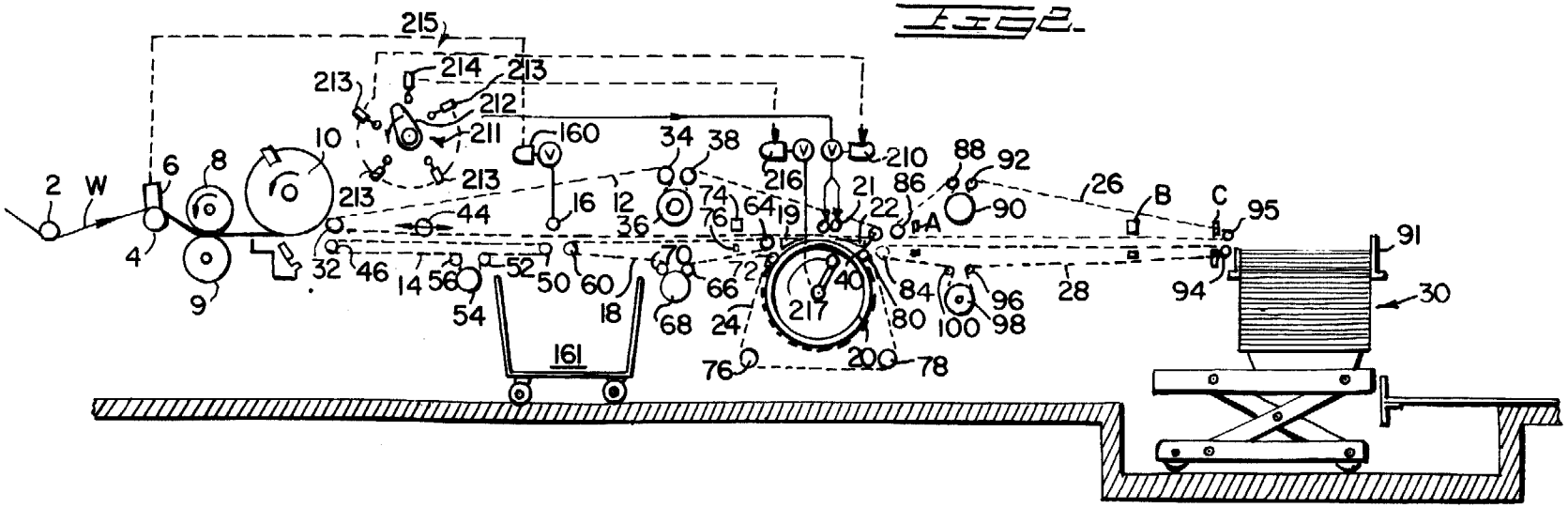
FIG. 2 is a view in sectional side elevation taken along the lines 2—2 of FIG. 1 and showing a comprehensive view of the machine of FIG. 1.

In FIG. 2 a paper web W is fed from an unwind stand (not shown) at high speed around a tension roll 2, over inspection roll 4 where it is viewed by inspection device 6, through a pair of feed rolls 8,9 and to the rotary sheet cutter unit 10 where the web is cut into sheets. Each sheet then travels between tapes 12 and 14 to the sorting air shower at 16 where the sheet is either accepted or rejected. The operation of the sorting air shower 16 is controlled by a solenoid valve 160 that receives signals from the paper web inspection device 6. Rejected sheets are discarded into the rejects box 161 while accepted sheets continue their travel between tapes 12 and 18 over the wedges 19 to the collecting drum 20. The collecting drum 20 is constructed as disclosed in applicant's prior U.S. Pat. No. 3,363,520. At the collecting drum, the accepted sheets are directed onto the drum by the collecting air shower 21. The collecting air shower 21 is controlled by the sheet collect solenoid valve 210 in response to signals from the air shower control unit 211. Air shower control unit 211 consists of a rotating cam 212 and a plurality of microswitches 213 and 214. The embodiment shown consists of five microswitches for a five sheet collection system. It should be understood however, that the machine could be set up for any odd collect number from five and up simply by adding more microswitches and changing the drive ratio between the cutter drum 20 and the air shower control 211 accordingly. The number of sheets collected must be an odd number for tandem collect, otherwise the packs would not build up alternately on the collecting drum. Furthermore, the number of sheets capable of being collected in each packet would depend primarily on the basis weight of the paper being cut.

Figure 4:
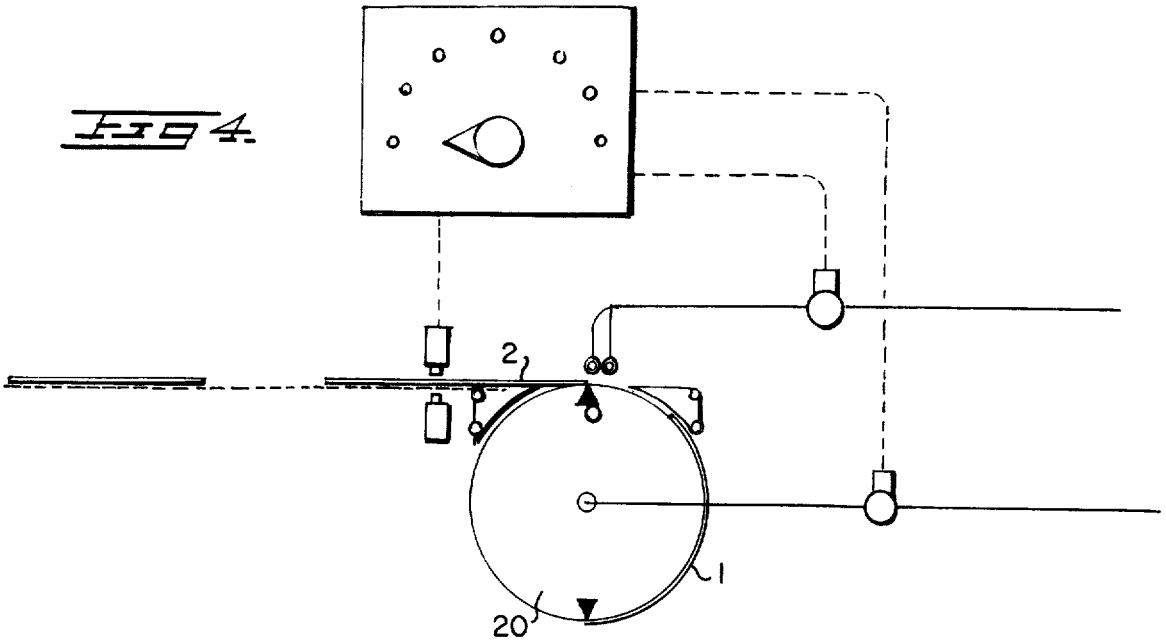
Figure 5:
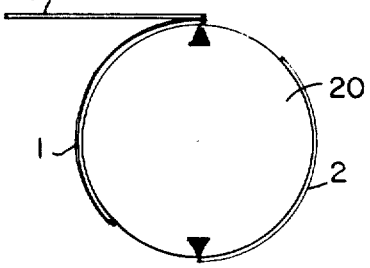
Figure 6:
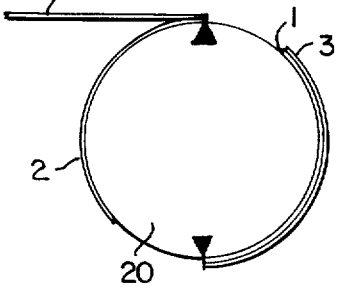
Figure 7:
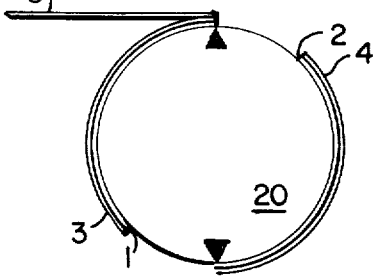
Figure 8:
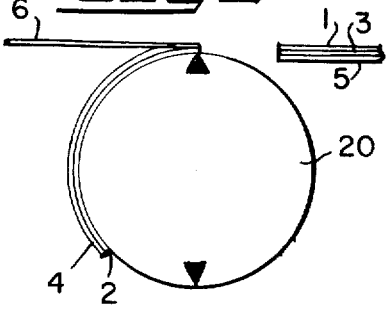

The sheets are alternately collected on the drum 20 and transferred therefrom as shown in FIGS. 4–18. Since the circumference of drum 20 is greater than the combined length of two cut sheets, and with the gear box 7 between the cutter drum 10 and the collecting drum 20 set in 2:1 ratio, the sheets are collected in individual packs as follows. When the machine is started and the web W is initially fed to the cutter drum 10, the first sheet is cut and travels between tapes 12 and 14 as shown in FIG. 2. If the sheet is not rejected by reject air shower 16, it continues between tapes 12 and 18 to the collecting drum 20. At the collecting drum 20 collect air shower 21 is actuated by the sheet collect solenoid valve 210 in response to the air shower control cam 212 engaging the first microswitch 213 to force the sheet onto the collecting drum 20. The sequence described thus far corresponds to one complete revolution of the cutter drum 10 and one-half of a revolution of the collecting drum 20 as shown in FIG. 4. Meanwhile, as additional sheets are cut by the cutter drum 10 the packs of sheets build up on the collecting drum 20 as the cam 212 of the air shower control sequentially engages the microswitches 213. The sheet packets are retained on the collecting drum 20 by the tapes 24 which are arranged in close proximity to the drum 20 by the guide rolls shown in FIG. 2. For every complete revolution of the collecting drum 20, two sheets are collected because of 2:1 ratio of the drive between cutter drum 10 and collecting drum 20. FIG. 5 shows the condition of the collecting drum 20 after one complete revolution with sheets 1 and 2 on the drum and sheet 3 about to be collected. FIG. 6 shows the drum 20 after one and one-half revolutions with sheets 1 and 2 in one packet and sheet 4 in position to be collected on top of sheet 2. FIG. 7 shows in a similar manner sheets 2 and 4 in a packet with sheet 5 ready for collection in the pack containing sheets 1 and 3. At this point, the air shower control system 215 has reached the condition where the cam 212 has sequentially engaged each of the collect microswitches 213 and is about to engage the transfer microswitch 214. As shown in FIG. 8, after five complete revolutions of the cutter drum 10 and 2½ revolutions of the collecting drum 20, cam 212 engages transfer microswitch 214 to actuate the sheet transfer solenoid valve 216 which actuates the transfer air shower 217 which in turn removes the first packet of sheets containing sheets 1, 3 and 5 from the collecting drum 20. FIG. 8 also shows the condition of the collecting drum 20 with sheet 6 about to be collected in the pack containing sheets 2 and 4. Thus, as the cam 212 of the air shower control system 215 continues to rotate, it once again engages the first microswitch 213 to collect sheet 6.

Figure 9:
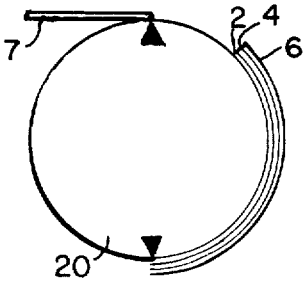
Figure 10:
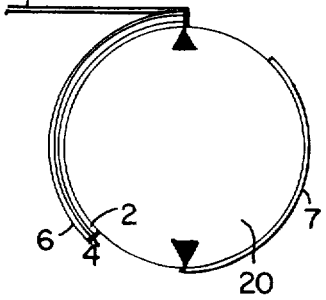

FIG. 9 shows the condition of the collecting drum 20 after three complete revolutions with sheets 2,4 and 6 in one pack and sheet 7 about to be collected on the now vacant side of the collecting drum 20. FIGS. 10, 11 and 12 show the collecting drum 20 as sheets 8,9 and 10 are collected and at this point, the cam 212 of air shower control 215 is once again approaching the transfer microswitch 214 which actuates the transfer solenoid 216 to activate the transfer air shower 217 and thereby remove the first complete 5 sheet packet from the collecting drum 20 as shown in FIG. 13. Accordingly, as shown in FIG. 13, sheets 2,4,6,8 and 10 are removed from the collecting drum 20 when cam 212 engages microswitch 214 and the collecting drum 20 is in condition to collect the next sheet 11 in the pack containing sheets 7 and 9. FIGS. 14–18 follow the same collecting and transfer sequence as shown in FIGS. 9–13 and are not believed to require a more detailed explanation.

It should be noted however, that the sequence of operation shown in FIGS. 4–18 assumes a situation where no sheets are rejected by the reject air shower 16. Thus once the cutter drum 10 has completed 10 revolutions and the collecting drum 20 has completed 5 revolutions, the machine is collecting complete packs of five sheets. If one or more defective sheets are detected by the sheet inspection device 6, they would be rejected by the reject air shower 16 into the reject box 161 and the machine would continue to operate by delivering packs of sheets to the slow down tapes 26, 28 containing less than five sheets. In order to provide an accurate count of the sheets actually delivered to the collecting drum 20, a sheet counting system is provided and consists of a photocell 74, and a photo lamp 76 which delivers signals to a sheet counter (not shown). The system employed is substantially the same as that shown in applicant's prior U.S. Pat. No. 3,272,044 (FIG. 35). Each sheet that passes the reject air shower 16 intercepts the light beam from lamp 74, and each interception advances the sheet counter one count until the 500 count (one ream) is reached. At that time, the sheet counter resets itself and 5 counts later produces an actuation signal for a ream flag to be inserted in the delivered stack. The ream flag can be inserted either manually or automatically by a ream flag inserter substantially as disclosed in applicant's prior patent noted above.

As may be appreciated from a consideration of the above detailed description, the machine can be operated in the tandem collect mode when cutting sheets that are shorter than one half the circumference of the collecting drum and by doing so will impose a reduced load on the sheet receiving system at the end of the machine. Thus the primary virtue of the tandem collect system is that it greatly reduces the load on the slow down sheet receiving system and the slow down drive motor, and since these are the major limiting elements of the machine the frequency of cuts per minute can be increased appreciably in the tandem collect mode as compared with the single collect mode.

The slow down sheet receiving system used in the present invention is substantially the same as the system fully described in applicants prior U.S. Pat. No. 3,272,044. In this regard, the packets of sheets are delivered by tapes 12 and 24 to tapes 26 and 28, which latter tapes go through a slow-down-speed-up cycle, first slowing down as they deliver a packet of sheets to stack 30, and then speeding back up to sync speed, or the same speed as the collecting drum in time to accept the next sheet packet.

Tapes 12 are carried on rolls 32,34,38,40 and 44 including the tape drive roll 36. Nip roll 44 is adjustable in the direction of the arrows passing through it and causes the tapes 12 to contact the tapes 14 and exert a slight pressure upon them. The arrangement shown forms a nip between the tapes and produces a gripping action on the cut sheets just before they are severed from the web W by the cutter drum 10. The details of the function of roll 44 is disclosed more fully in applicant's aforementioned prior patent. Tapes 14 pass over rolls 46,50,52,56 including the drive roll 54. Tapes 18 pass over rolls 60,64,66 and 70 including drive roll 68. Tapes 26 are carried on rolls 86,88,92 and 95 including drive roll 90 tapes 28 are carried on rolls 84,94,96,100 including drive roll 98. Meanwhile, tapes 24 for the collecting drum 20 are passed around rolls 72,76,78,80 and the collecting drum 20 itself. All tape runs have provisions for take-up adjustment substantially as disclosed in applicant's prior U.S. patents. It will also be noted that all tapes run at the same surface speed as collecting drum 20. Meanwhile, in the tandem collect mode, the cutter drum 10 runs at twice the speed of the collecting drum to produce twice as many cut sheets as the machine would normally handle in the single collect mode.

Figure 1:
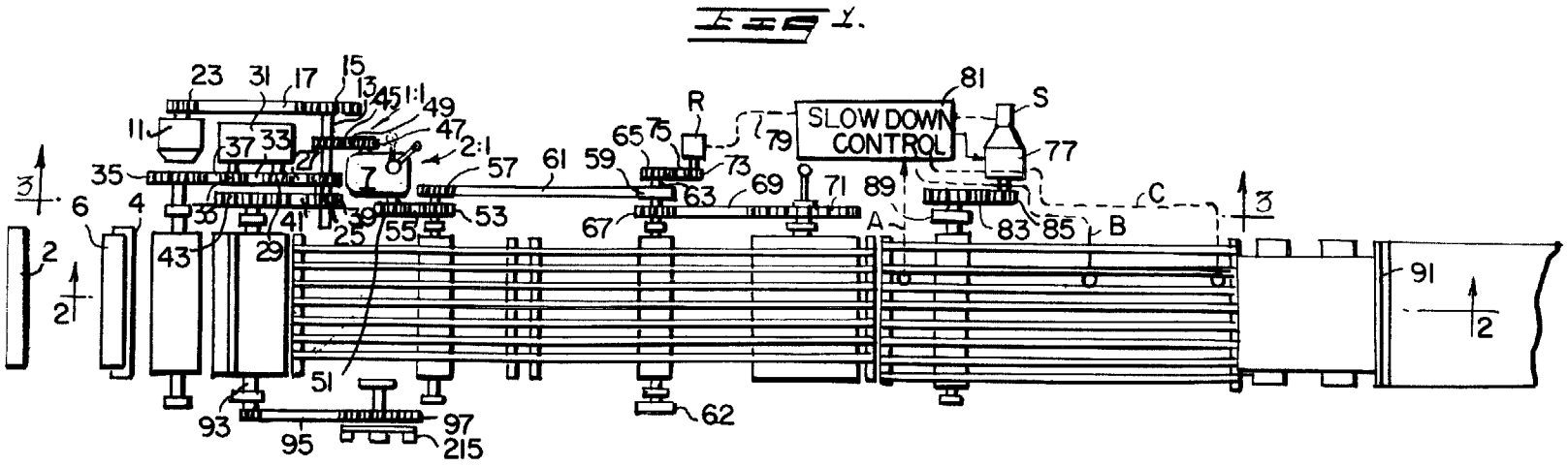
FIG. 1 is a diagrammatic plan view of a single web sheet cutter and stacker incorporating the features of the present invention.
Figure 3:
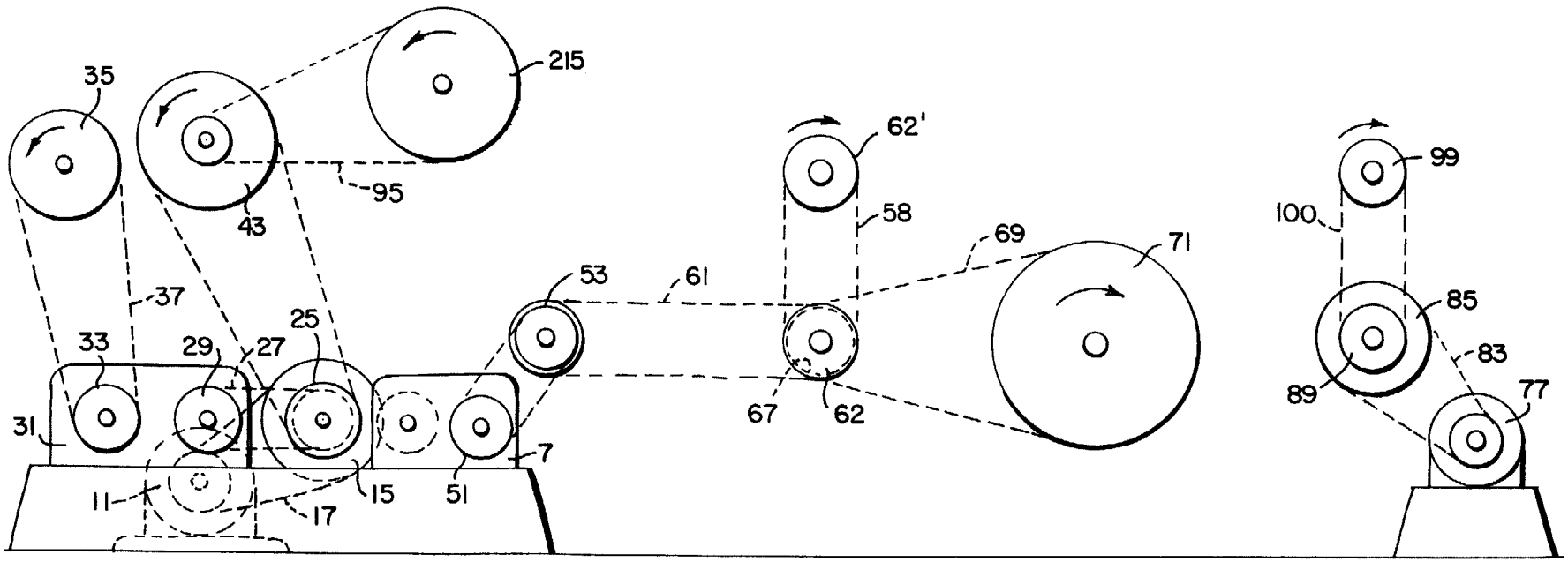
FIG. 3 is a view in sectional side elevation taken along the lines 3—3 of FIG. 1 and showing the drive mechanism of the machine of FIG. 1.

The main machine drives and tape drives are shown in FIGS. 1 and 3. Motor 11 drives jack shaft 13 by means of timing gear 23, timing belt 17 and timing gear 15. Timing gear 25 mounted on jack shaft 13 drives the input timing gear 29 of the sheet ratio drive unit 31. Output timing gear 33 of the sheet ratio drive unit 31 drives the timing gear 35 of the feed roll 8 by means of the timing belt 37, and the timing gear 39 on jack shaft 13 drives the timing gear 43 of cutter drum 10 by means of the timing belt 41. Thus it may be seen that the cutter drum 10 is driven off the jack shaft 13 while the feed roll 8 is driven off the same jack shaft but through the sheet ratio drive unit 31. At the front side of the machine the cutter drum 10 has a timing gear 93 mounted on its shaft which drives the timing gear 97 of the air shower control 215 through the timing belt 95. The ratio of this drive has been set forth hereinbefore as it relates to the number of sheets collected in a packet.

Also mounted on the jack shaft 13 is the timing gear 45 which drives the input timing gear 47 of the gear box 7 by means of the timing belt 49. As noted in FIG. 1, the gear box 7 can be operated at two different ratios, 1:1 for the single collect mode and 2:1 for the tandem collect mode. The output drive of the gear box 7 consists of a timing gear 51 which drives the tape drive roll 54 by means of a timing gear 53 and timing belt 55. Also mounted on the tape drive roll 54 is a second timing gear 57 which drives through the timing belt 61, the input timing gear 59 of the lower tape drive roll 68. Drive shaft 63 of tape drive roll 68 includes two additional timing gears 65 and 67 which drive respectively the tach generator R and the collecting drum 20. Thus, timing gear 65 drives the timing gear 73 of tach generator R by means of the timing belt 75 and timing gear 67 drives the input timing gear 71 of collecting drum 20 by means of the timing belt 69. Tach generator R provides an input signal 79 that is fed to the slow down control unit 81 which also receives signals from the delivery end of the machine. Meanwhile, the upper tape drive roll 36 is driven by a timing belt 58 off the timing gear 62 located on the front end of the tape drive roll shaft 63.

At the sheet delivery end of the machine, the slow-down-speed-up motor 77 drives the lower tape drive roll 98 via a timing belt 83 and a timing gear 85. Meanwhile upper tape drive roll 90 is driven by a timing belt 87 and the timing gear 89. Slow-down-speed-up motor 77 has a direct drive to the tach generator S which delivers a second input signal to the slow down control unit 81. The slow-down-speed-up cycle for receiving sheets from the collecting drum 20 and delivering them to the stacker 30 operates in response to signals that are generated by the photocells A, B and C. Photocell A initiates slow down for the single collect mode and Photocell B initiates slow down for the tandem collect mode. The photocells actually "see" the trailing end of the sheet packet to produce the desired results. The timing of the slow down cycle is such that the individual sheet packets are accepted by the tapes 26 and 28 at the speed of the collecting drum 20, and as soon as the packet is clear of the collecting drum, the photocell beam A or B becomes re-established and the slow down of the tape begins. The tapes attain a minimum speed equal to about 150 FPM just as the leading end of the sheet packet contacts the back stop jogger 91 of the stacker 30. At that point, the trailing end of the sheet packet has passed the third photocell C, which because of its re-established beam sends a signal to the slow down control unit 81 which in turn actuates the slow down motor 77 and thereby accelerates the speed of the tapes 26,28 back up to the speed of the collecting drum 20, ready to accept the next packet of sheets as soon as it has been collected.

In the slow down system, at the time of transfer from the collecting drum 20 to the slow down tapes 26,28, the slow down tapes must be running at the same speed as the collecting drum. The delivery tapes 12, 18 from the cutter drum 10 to the collecting drum 20 also run at the same speed. Thus, in order to attain this synchronized speed of all the components, the output signal of tach generator S is compared with the output signal of tach generator R in the slow down control system, and the speed of the slow down tapes are automatically adjusted until they are synchronized with the rest of the system.

From the foregoing specification, it may be seen that the invention herein provides a substantial improvement in the machines disclosed in applicant's prior U.S. Pat. Nos. 3,203,326 and 3,272,044. Furthermore, even though the invention herein has been described in detail for use on a single web of paper, in those situations where the sheets did not have to be inspected and sorted, and where the desireability of having all of the sheets come from the same roll of paper was not required, the machine of the present invention could operate effectively on multiple webs from different rolls.

While certain preferred embodiments of the invention have been illustrated and described in detail, it is to be understood that many variations and modifications could be made by one skilled in the art within the scope of the appended claims.

I claim:

1. A high speed sheet cutting, delivering and stacking mechanism comprising in combination, means for advancing sheet material in web form to a sheet cutting device where the web is cut into sheets, a sheet conveying means for conveying the cut sheets to a foraminous sheet collecting drum where the individual cut sheets are collected, air shower means for guiding individual sheets onto said foraminous collecting drum in registered packets and for removing the packets of sheets from said foraminous collecting drum, a common drive means for the sheet cutting device, sheet conveying means and foraminous collecting drum, and a slow-down-speed-up sheet packet transfer conveying means for accepting packets of sheets from said foraminous collecting drum and delivering said sheet packets to a sheet stacking means, the improvement comprising:

a. a transmission means having a 2:1 drive ratio connected between said sheet cutting device and said foraminous collecting drum; and, b. an air shower control means driven by said sheet cutting device for actuating said air shower means to collect packets of cut sheets that are shorter in length than one half the circumference of said foraminous collecting drum in tandem on said foraminous collecting drum.

2. A sheet cutting, delivering and stacking mechanism as set forth in claim 1 wherein the air shower control means further comprises a cam device that is driven directly by said sheet cutting device and a plurality of air shower controlling microswitches that are contacted in sequence by said cam device.

3. A sheet cutting, delivering and stacking mechanism as set forth in claim 2 wherein the cam device is driven by said cutting drum at a speed ratio that corresponds to the number of sheets cut for collection in an individual packet.

4. A sheet cutting, delivering and stacking mechanism as set forth in claim 3 wherein the total number of said microswitches is an odd number and corresponds to the number of sheets cut for collection in an individual packet with one microswitch triggering the air shower means for removing packets of sheets from said foraminous collecting drum and the remainder of said microswitches triggering the air shower means for guiding individual sheets onto said foraminous collecting drum.

5. A sheet cutting, delivering and stacking mechanism as set forth in claim 4 wherein the slow-down-speed-up sheet packet transfer conveying means accepts packets of sheets at the normal speed of said foraminous collecting drum and then slows the sheet packets down to a relatively low speed for delivery to said stacking means before returning to the normal speed of said foraminous collecting drum, said slow-down-speed-up cycle being governed by sheet packet detecting means incorporated within the sheet packet transfer conveying means.

6. A sheet cutting, delivering and stacking mechanism as set forth in claim 5 wherein the sheet packet detecting means further comprises photocells which are positioned on said sheet transfer means as a function of the sheet length cut by the said sheet cutting device.

7. In a sheet cutting, collecting and transferring mechanism, in combination, a sheet cutting device, a foraminous drum for collecting individual sheets thereon one after another and for accumulating the sheets in registered packets, first air shower means disposed above said drum for guiding the individual sheets onto said drum, second air shower means disposed within said drum for removing the accumulated sheets from said drum and a common drive means for the sheet cutting device and the foraminous collecting drum, the improvement comprising:

a. a transmission means between said sheet cutting device and said foraminous collecting drum having a 1:1 drive ratio for single collect and a 2:1 ratio for tandem collect; and, b. an air shower control means driven by said sheet cutting device consisting of a plurality of switches which actuate the first and second air shower means for collecting single packets of sheets in the 1:1 drive ratio of said transmission and tandem packets of sheets in the 2:1 drive ratio of said transmission.

8. The sheet cutting, collecting and transferring mechanism of claim 7 wherein with the transmission means in the 2:1 drive ratio the foraminous collecting drum operates at one-half the speed of the sheet cutting device and the length of the sheets collected in tandem is less than one-half the circumference of the foraminous collecting drum.

* * * * *